US009761406B2

(12) United States Patent
Takasaki et al.

(10) Patent No.: US 9,761,406 B2
(45) Date of Patent: Sep. 12, 2017

(54) RADIATION TUBE AND RADIATION INSPECTION APPARATUS

(71) Applicant: CANON KABUSHIKI KAISHA, Tokyo (JP)

(72) Inventors: Koichi Takasaki, Tokyo (JP); Noritaka Ukiyo, Inagi (JP); Osamu Taniguchi, Chigasaki (JP); Takao Ogura, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 20 days.

(21) Appl. No.: 14/561,118

(22) Filed: Dec. 4, 2014

(65) Prior Publication Data

US 2015/0162162 A1 Jun. 11, 2015

(30) Foreign Application Priority Data

Dec. 9, 2013 (JP) ..... 2013-254542

(51) Int. Cl.
*H01J 35/00* (2006.01)
*H01J 35/16* (2006.01)
*G21K 1/02* (2006.01)

(52) U.S. Cl.
CPC ..... *H01J 35/16* (2013.01); *G21K 1/02* (2013.01); *H01J 2235/087* (2013.01); *H01J 2235/165* (2013.01)

(58) Field of Classification Search
CPC ..... H01J 2235/165; H01J 35/16
See application file for complete search history.

(56) References Cited

U.S. PATENT DOCUMENTS

| | | | | |
|---|---|---|---|---|
| 6,183,139 | B1 | 2/2001 | Solomon | |
| 2004/0213378 | A1 | 10/2004 | Zhou | |
| 2006/0291628 | A1* | 12/2006 | Clayton | G01N 23/005 378/143 |
| 2011/0096906 | A1* | 4/2011 | Langeveld | G01N 23/063 378/82 |
| 2013/0129045 | A1* | 5/2013 | Ogura | H01J 5/18 378/62 |

FOREIGN PATENT DOCUMENTS

| | | | | |
|---|---|---|---|---|
| JP | WO 2011105035 | A2 * | 9/2011 | H01J 35/08 |
| JP | 2013-88199 | A | 5/2013 | |

* cited by examiner

*Primary Examiner* — Dani Fox
(74) *Attorney, Agent, or Firm* — Canon USA, Inc. IP Division

(57) ABSTRACT

A radiation tube includes an enclosure having an opening portion, an electron source disposed inside the enclosure, a target unit configured to generate radiation by being bombarded with electrons emitted from the electron source, and a front shield disposed on the opening portion and joined to the target unit. The front shield has a slit-shaped opening that shields some of the radiation radiated from the target unit. The radiation is radiated through the opening in the shape of a fan beam.

13 Claims, 10 Drawing Sheets

FRONT VIEW

SIDE VIEW

FRONT VIEW

SIDE VIEW

RADIATION TUBE AND RADIATION INSPECTION APPARATUS

BACKGROUND

Field of the Invention

The present disclosure relates to a radiation tube applicable to non-destructive X-ray inspection apparatuses in an industrial equipment field or a medical equipment field and a radiation inspection apparatus using the radiation tube.

Description of the Related Art

Radiation tubes produce radiation, such as an X-ray, by applying a high voltage between a cathode and an anode and emitting electrons from an electron source to a target. For example, a radiation tube is applied to an inspection apparatus for inspecting a foreign substance in an article as an X-ray source.

Japanese Patent Laid-Open No. 2013-88199 describes an X-ray inspection apparatus including an X-ray source that emits an X-ray beam to an article, a slit forming member that controls the irradiation area of the X-ray beam, and a conveyance unit that conveys an article.

FIG. 10 illustrates an existing X-ray inspection apparatus 301. The X-ray inspection apparatus 301 conveys an article to be inspected 307 using a conveyance unit 304, emits an X-ray beam from an X-ray tube 302 to the article 307, and detects the X-ray beam passing through the article 307 using an X-ray line sensor 305. The X-ray inspection apparatus 301 controls the irradiation area of an X-ray beam 308 in the shape of a cone emitted from an X-ray tube 302 using a slit forming member 306 having a slit extending in a direction perpendicular to a direction in which the article 307 is conveyed. The dashed arrows indicate X-ray beams scattered from the slit forming member 306. To block the X-ray beams from being emitted to the outside of an inspection space, an X-ray shielding wall 309 is provided.

In the X-ray inspection apparatus 301, a distance between an X-ray focal position (a target) and the slit is large and, thus, the X-ray is scattered into a wide area between the target and the slit. Accordingly, an area in which the X-ray shielding wall 309 needs to be provided increases. As a result, the size of the apparatus is disadvantageously increased.

SUMMARY

As disclosed herein, a radiation tube includes an enclosure having an opening portion, an electron source disposed inside the enclosure, a target unit configured to generate radiation by being bombarded with electrons emitted from the electron source, and a front shield disposed on the opening portion and joined to the target unit. The front shield has a slit-shaped opening that shields some of the radiation radiated from the target unit.

Further features of the present invention will become apparent from the following description of exemplary embodiments with reference to the attached drawings.

DESCRIPTION OF THE EMBODIMENTS

Exemplary embodiments of the present disclosure are described below with reference to the accompanying drawings. As disclosed herein, an X-ray is suitably used as radiation. Alternatively, the radiation such as a neutron ray or a proton beam may be used.

First Exemplary Embodiment

Figure 1:
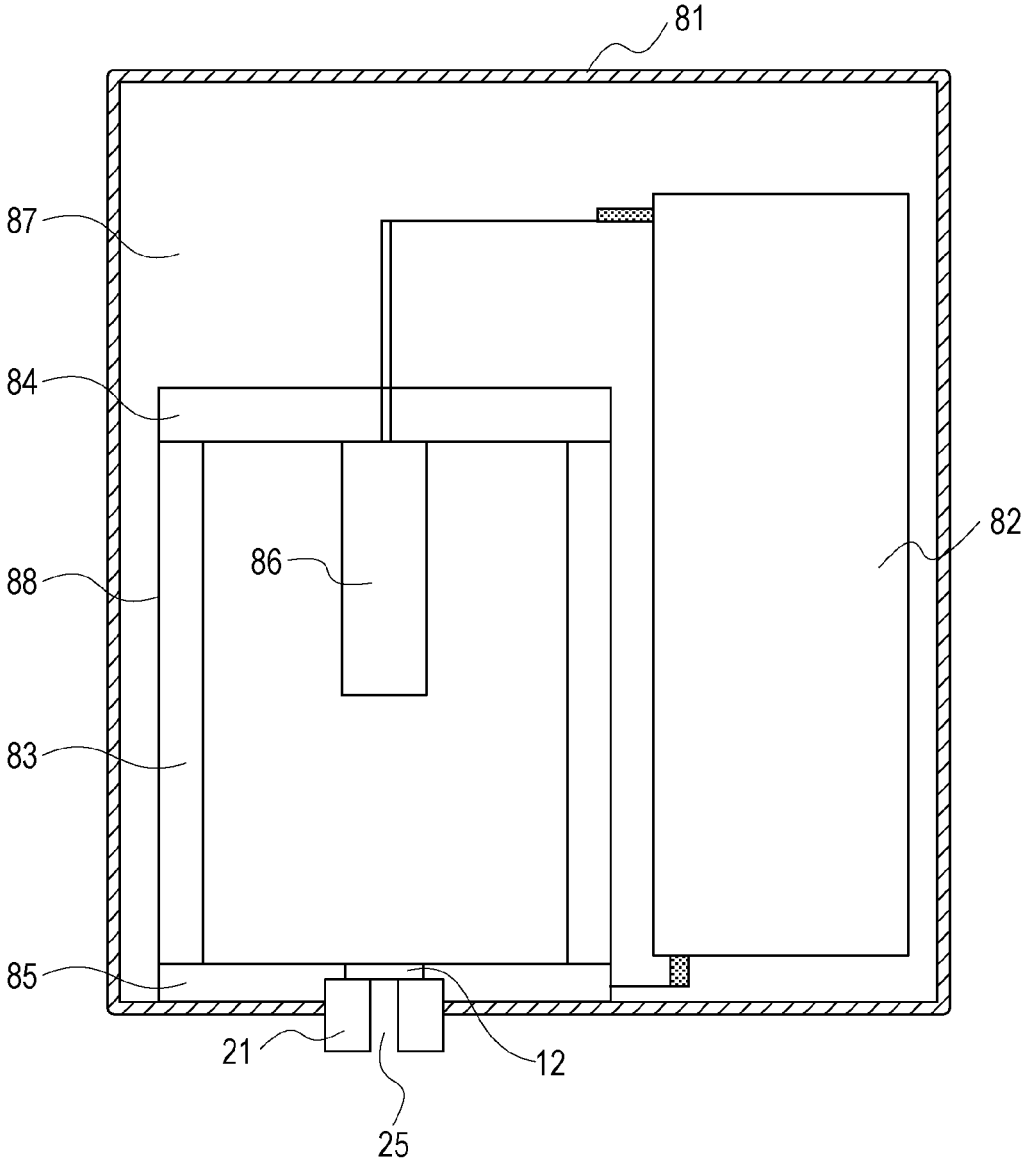
FIG. 1 is a schematic illustration of a radiation source according to a first exemplary embodiment.

FIG. 1 is a schematic illustration of the radiation source according to the present exemplary embodiment. A radiation source 81 includes a radiation tube 88 and a high voltage generation unit 82 disposed in a container. A void space of the container is filled with insulating oil 87. The radiation tube 88 includes an enclosure having a cylindrical insulating tube 83. One end portion of a cylindrical insulating tube 83 is joined to a cathode 84, and the other end portion is joined to an anode 85. The high voltage generation unit 82 applies a desired voltage to each of the cathode 84 and the anode 85. Electrons emitted from an electron source 86 that constitutes the cathode 84 are accelerated by an accelerating voltage (a voltage between the cathode and the anode) and strike a target unit 12. Among radiation generated when the electrons strike the target unit 12, the radiation radiated from a surface of the target unit 12 opposite to the surface which the electrons strike are emitted to the outside of the enclosure. That is, according to the present exemplary embodiment, the radiation tube 88 is of a transmission type.

A front shield 21 is connected to an opening portion of the enclosure (an anode flange portion) and blocks some of the radiation emitted from the target unit 12. That is, the radiation produced by the radiation tube 88 are emitted in the form of fan beam by the front shield 21 that has a slit-shaped (rectangular) opening 25 and that is connected to the target unit 12.

The insulating tube 83 is made of an electrically insulating material, such as a ceramic material (e.g., alumina) or glass. The flange portion of each of the cathode 84 and the anode 85 is made of an alloy of a low coefficient of linear expansion, such as MONEL® (Ni—Cu based alloy), INCONEL® (Ni-based superalloy), or KOVAR® (Fe—Ni—Co based alloy), or a metal, such as a stainless steel.

The electron source 86 is disposed in the enclosure so as to face the target unit 12 that constitutes the anode 85. The electron source 86 includes a hot cathode, such as a tungsten filament or an impregnated cathode, or a cold cathode, such as a carbon nano-tube. The electron source 86 has a lead electrode and a lens electrode disposed therein used for performing control so that the electrons reach a desired position and region of the target unit 12.

Figure 2A:
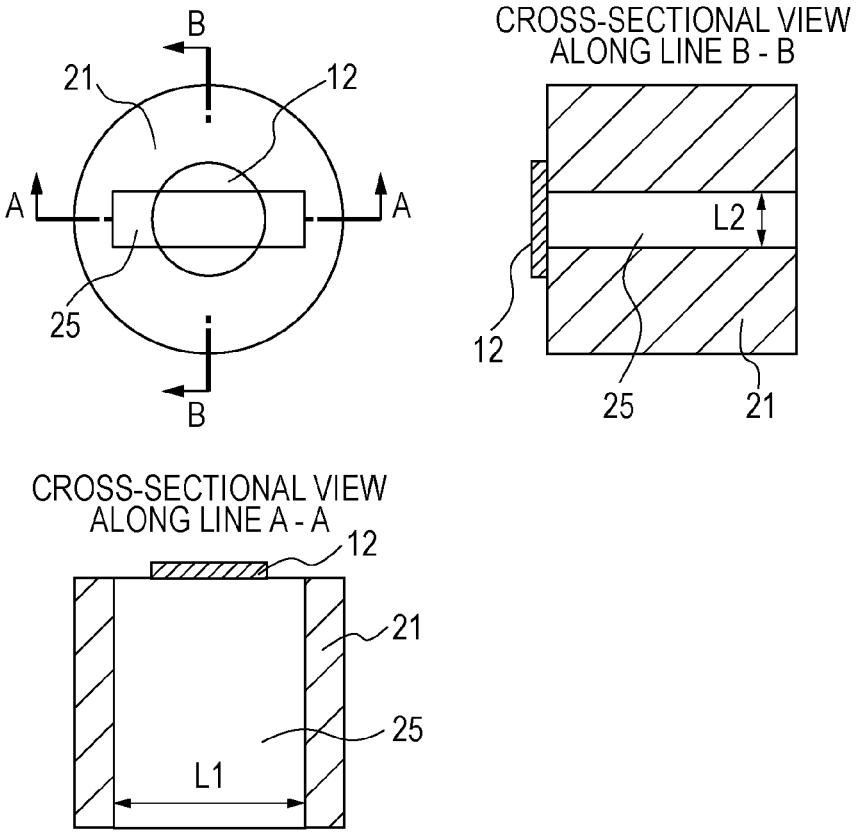
FIGS. 2A and 2B are schematic illustrations of a front shield and a target unit according to the first exemplary embodiment.

FIG. 2A is a schematic illustration of the front shield 21. FIG. 2A includes a front view, a cross-sectional view taken along a line A-A, and a cross-sectional view taken along a line B-B. The front shield 21 has the slit-shaped opening 25 (a radiation passage hole). The ratio of a longitudinal width (L1) to a transverse width (L2) of the opening 25 is about 2:1 to about 50:1 and is, more preferably, about 4:1 to about 20:1.

Figure 2B:
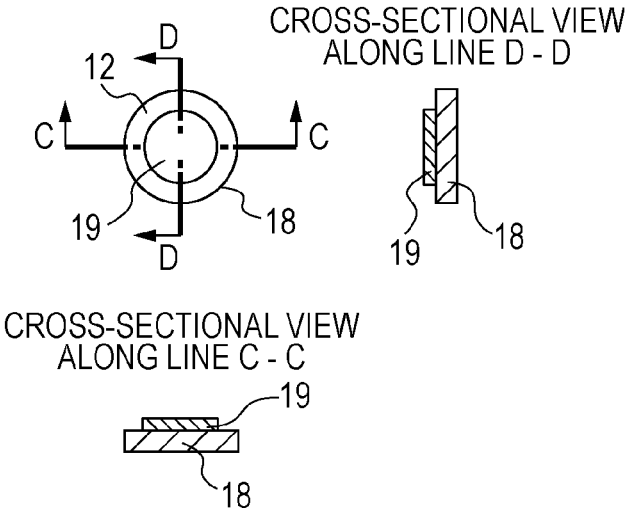

As illustrated in FIG. 2B, the target unit 12 includes a disk-shaped base member 18 and a circular target film 19 formed on a surface of the base member 18 adjacent to the electron source (a surface opposite to a connection surface with the front shield 21). It is desirable that the base member 18 have a strength to support the circular target film 19 and retain vacuum in the enclosure. In addition, it is desirable that the base member 18 have low absorption of the radiation generated by the target film 19 and a high thermal conductivity so that heat generated by the target film 19 is promptly dissipated. For example, diamond, silicon carbide, or aluminum nitride can be used for the base member 18.

It is desirable that the material used for the target film 19 have a high melting point and a high radiation generation efficiency. For example, tungsten, tantalum, or molybdenum can be used as the material. To reduce absorption of the generated radiation when the radiation passing through the target film 19, it is desirable that the target film 19 is about 1 μm to about 100 μm in thickness. For the same reason, it is desirable that the base member 18 is 500 μm to 5 mm in thickness.

It is desirable that the front shield 21 have a high shielding capability against radiation. It is further desirable that the front shield 21 have a high thermal conductivity to dissipate heat generated by the target unit 12 to the outside. The front shield 21 is made of a metal, such as copper, iron, nickel, tungsten, or lead, an alloy containing such a metal as a main component, or a composite material of such materials. In addition, since the front shield 21 is disposed such that part of the front shield 21 protrudes from the inside to the outside of the enclosure, the heat generated by the target unit 12 is promptly dissipated to the outside via the front shield 21.

Figure 4A:
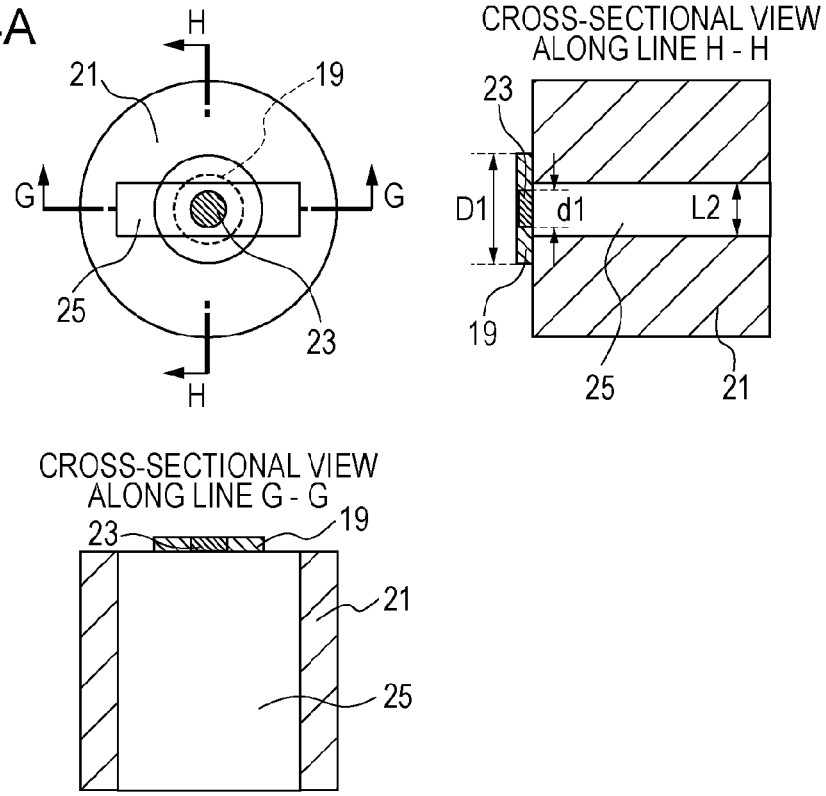
FIGS. 4A and 4B are schematic illustrations of an opening of a rear shield according to the first exemplary embodiment.

FIG. 4A is a schematic illustration of the slit-shaped opening 25 of the front shield 21 and the diameter of an electron beam emitted onto the target film 19. That is, FIG. 4A illustrates a positional relationship between the opening 25 and a focal point 23 of the electron beam. A diameter d1 of the focal point 23, a diameter D1 of the target film 19, and a transverse width L2 of the opening 25 satisfy the following expression:

$$d1<L2\leq D1.$$

That is, the transverse width is greater than the diameter of the focal point and is less than the diameter of the target film. By setting such a relationship, the radiation emitted in the shape of a cone at the focal point 23 can be reformed into fan-beam shaped radiation. In addition, the radiation emitted in an unnecessary direction can be efficiently blocked.

Second Exemplary Embodiment

Figure 3:
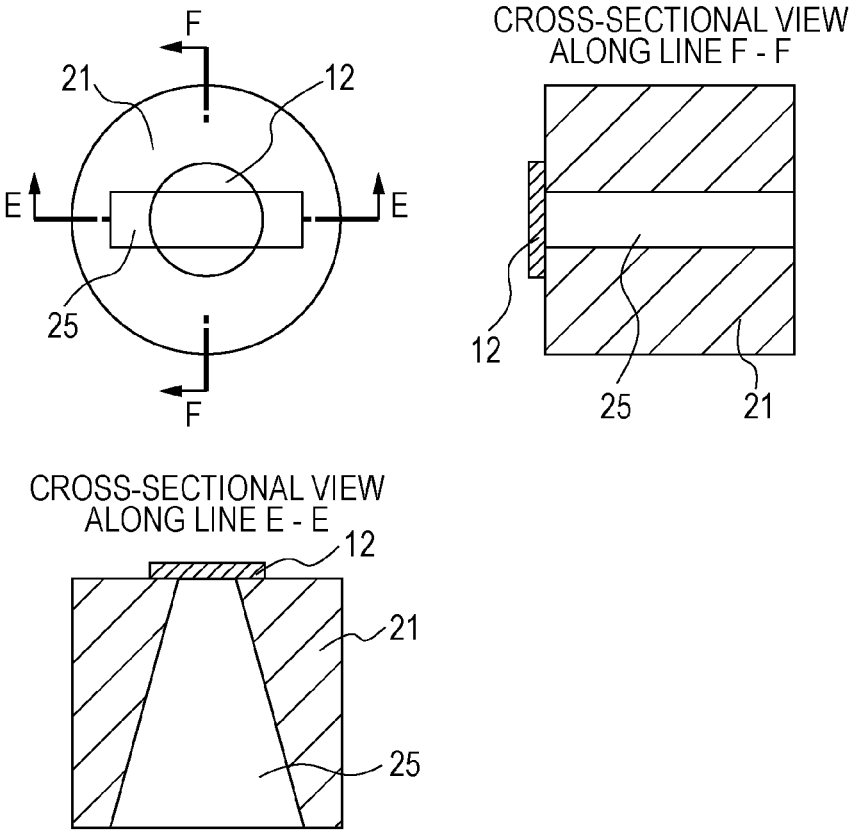
FIG. 3 is a schematic illustration of a front shield according to a second exemplary embodiment.

FIG. 3 is a schematic illustration of the front shield 21. FIG. 3 includes a front view, a cross-sectional view taken along a line E-E, and a cross-sectional view taken along a line F-F. The slit-shaped opening 25 has a taper so that the longitudinal width increases from the target unit side to the outside. By increasing the thickness of the front shield 21 in a region around the target unit where the dosage to be shield is large, the size of the front shield 21 required for blocking unnecessary radiation can be reduced. In addition, the taper need not be a linear taper if a portion of the opening 25 adjacent to the target unit in the longitudinal direction is narrower than a portion on the emission side. For example, the taper may be a stepped taper. It is desirable that the longitudinal width of the end portion adjacent to the target unit be wider than the diameter of the focal point and be the same as the diameter of the opening of a rear shield 64 (described in more detail below). Furthermore, it is desirable that the longitudinal width be the same as the transverse width (L3 =L2, that is, the end portion adjacent to the target unit is square in shape).

Figure 4B:
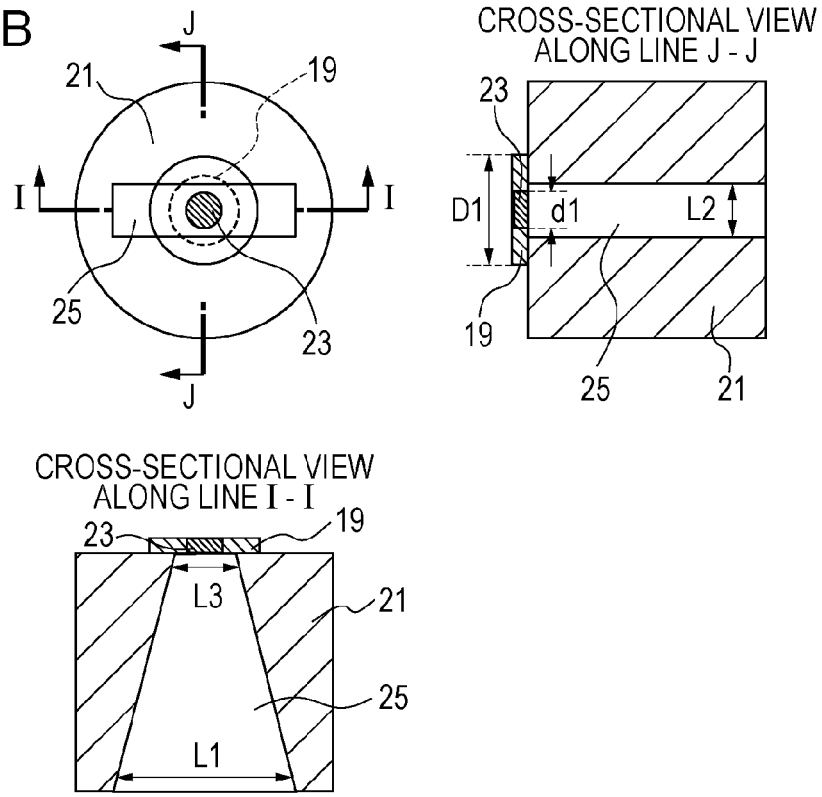

FIG. 4B is a schematic illustration of a positional relationship between the opening 25 of the front shield 21 and the focal point 23. The diameter d1 of the focal point 23, the diameter D1 of the target film 19, and the transverse width L2 of the opening 25 satisfy the following expression:

$$d1<L2\leq D1.$$

By setting such a relationship, the radiation emitted in the shape of a cone at the focal point 23 can be reformed into fan-beam shaped radiation. In addition, the radiation emitted in an unnecessary direction can be efficiently blocked.

Third Exemplary Embodiment

Figure 5:
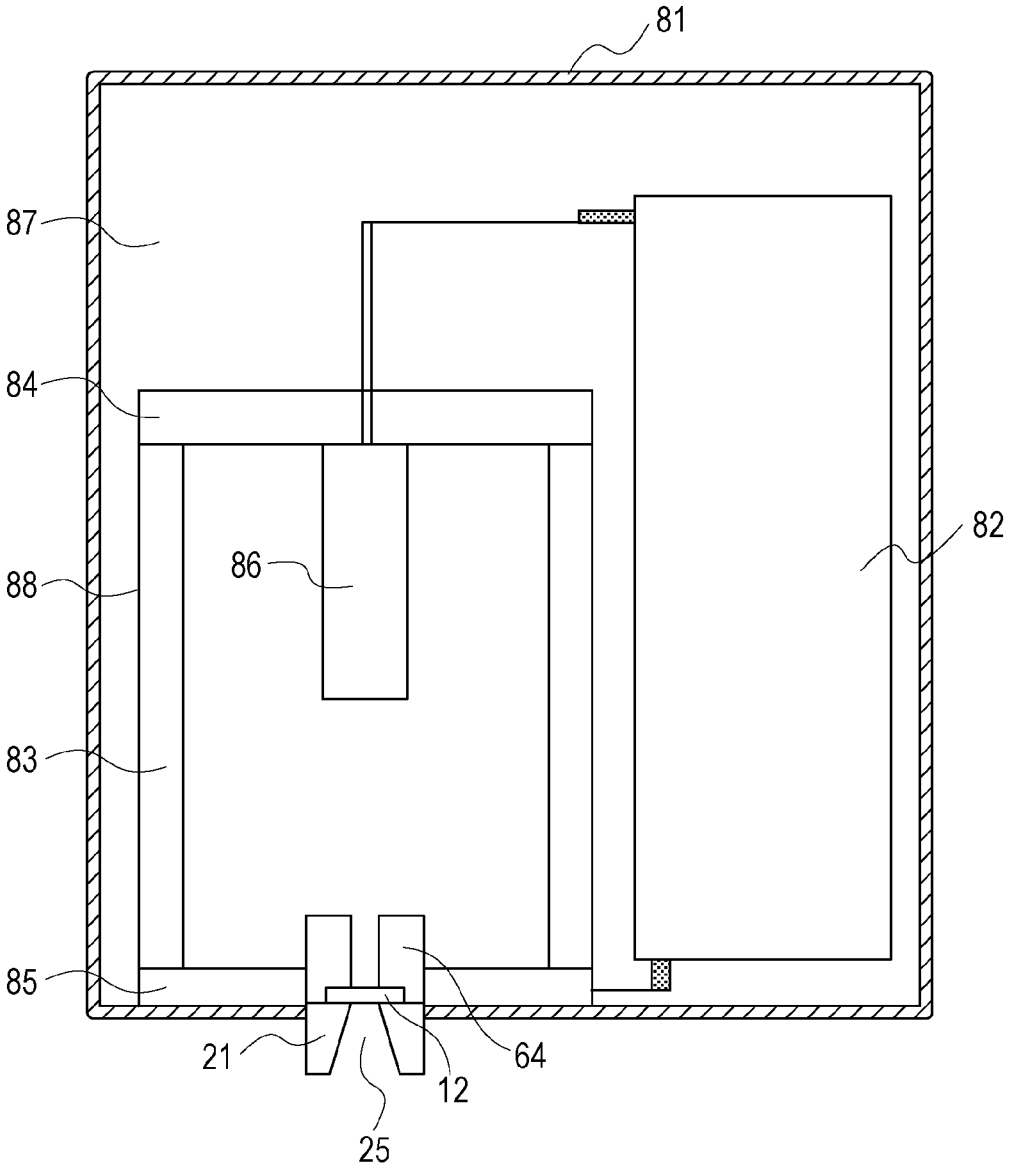
FIG. 5 is a schematic illustration of a radiation source according to a third exemplary embodiment.

FIG. 5 is a schematic illustration of the radiation source according to the present exemplary embodiment. The configuration is similar to those of the first or second exemplary embodiments except that the rear shield 64 is additionally disposed.

Radiation and reflected electrons generated on the cathode side of the target unit 12 are blocked by the rear shield 64. The material of the rear shield 64 is the same as that of the front shield 21. In addition, each of the front shield 21 and the rear shield 64 may have a double-layered structure in which a material having a high shielding effect (e.g., tungsten) is disposed inside and a material having a high thermal conductivity (e.g., copper) is disposed outside.

Figure 6A:
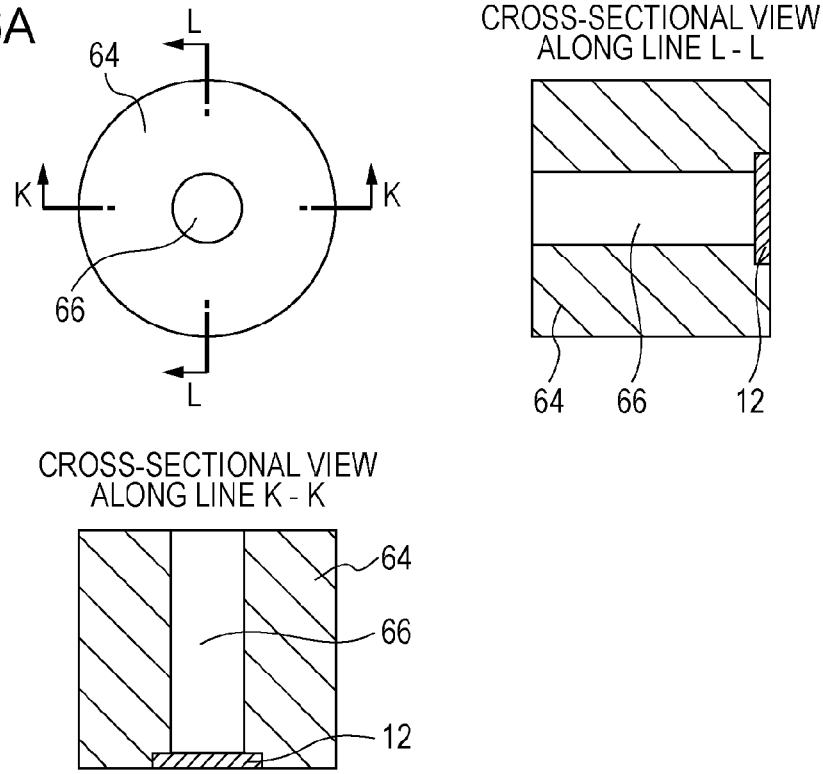
FIGS. 6A and 6B are schematic illustrations of a rear shield according to the third exemplary embodiment.
Figure 6B:
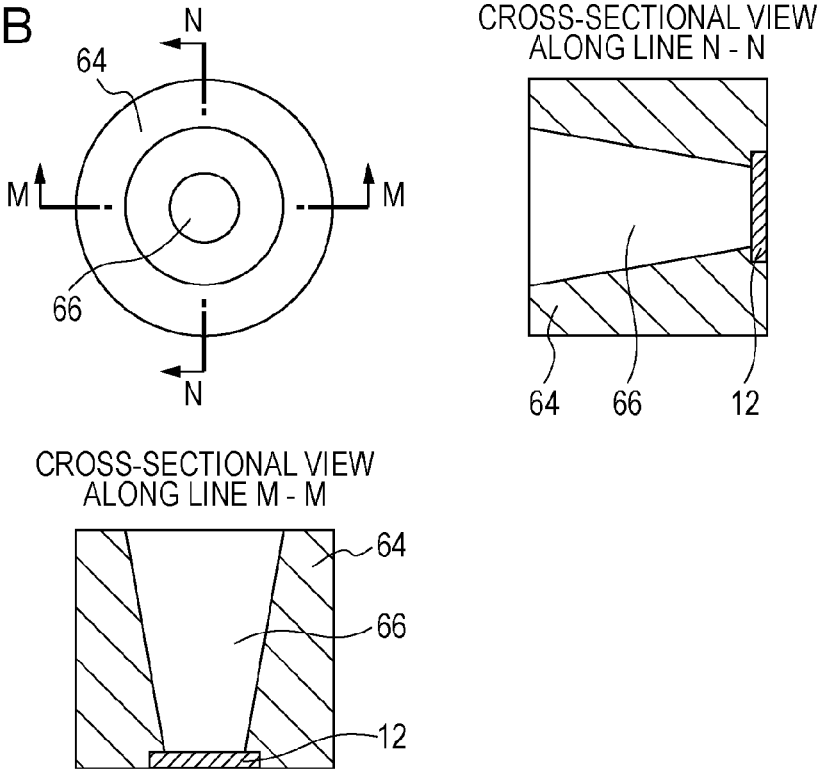

FIGS. 6A and 6B are schematic illustrations of the rear shield 64. FIG. 6A includes a front view, a cross-sectional view taken along a line L-L, and a cross-sectional view taken along a line K-K. As illustrated in FIG. 6A, the rear shield 64 has a cylindrical opening (an electron passage hole) 66. The rear shield 64 is connected to the target unit 12. The target unit 12 is fitted into a notch formed in the end portion of the rear shield 64 and is joined to the rear shield 64. The front shield 21, the target unit 12, and the rear shield 64 are joined to the opening portion of an anode flange portion in an integrated manner.

In addition, as illustrated in FIG. 6B, the opening 66 may be tapered. Such a structure effectively blocks the radiation around the target unit where unnecessary dosage increases. In addition, such a structure prevents the electrons from striking a side surface of the rear shield adjacent to the cathode and, thus, prevents generation of unnecessary radiation. Furthermore, if the size of the opening 66 of the rear shield on the target unit side is smaller than that on the cathode side, the taper needs not be a linear taper. For example, a stepped taper may be employed.

Fourth Exemplary Embodiment

Figure 7:
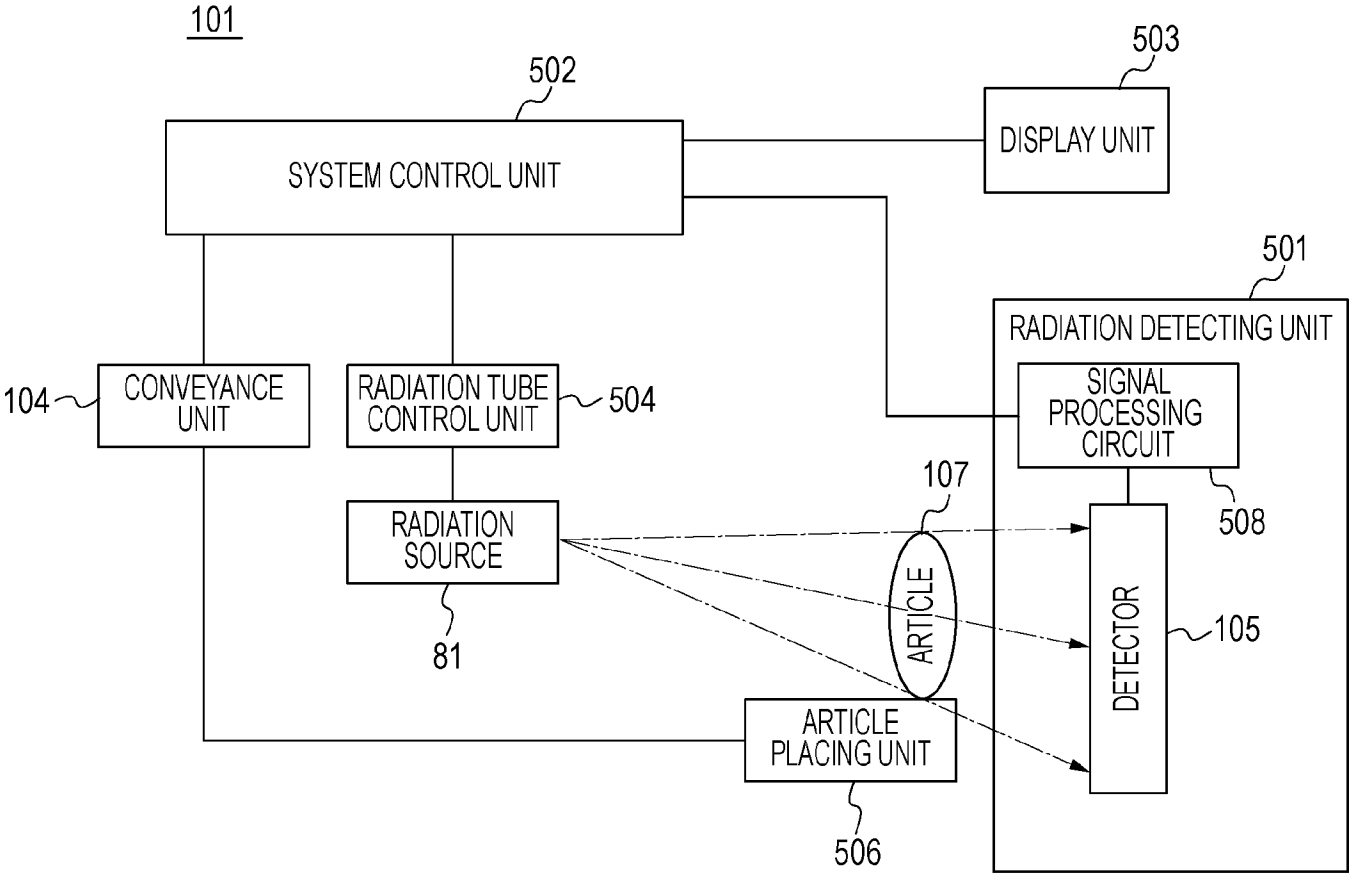
FIG. 7 is a block diagram of a radiation inspection apparatus according to a fourth exemplary embodiment.

The radiation inspection apparatus according to the present exemplary embodiment is described below with reference to FIG. 7. A system control unit 502 controls the radiation tube 88, a radiation detecting unit 501, and a conveyance drive unit 505 so that the radiation tube 88, the radiation detecting unit 501, and the conveyance drive unit 505 cooperatively operate. The radiation tube described in one of the first to third exemplary embodiments is used as the radiation tube 88. Under the control of the system control unit 502, a radiation tube control unit 504 outputs a variety of control signals to a radiation source 81. The radiation emitted from the radiation tube 88 is controlled by the control signals. The conveyance drive unit 505 drives an article placing unit 506 so that an article to be inspected passes between the radiation tube 88 and a detector 507. The radiation emitted from the radiation tube 88 penetrates an article 509 and is detected by the detector 507. The detector 507 converts the detected radiation into an electric signal and outputs the electric signal to a signal processing circuit 508. Under the control of the system control unit 502, the signal processing circuit 508 performs predetermined signal processing on the electric signal and outputs the processed electric signal to the system control unit 502. The system control unit 502 generates an image signal on the basis of the processed electric signal and instructs a display unit 503 to display a video image of the inside of the article on the basis of the image signal. In addition, the system control unit 502 determines whether a foreign substance is included in the article. The result of the determination is displayed on the display unit 503. The article 509 that has been already inspected is conveyed to one of different predetermined locations by the article placing unit 506 in accordance with the result of the determination. The article 509 is continuously conveyed at predetermined intervals, and radiation is emitted from the radiation tube 88 in synchronization with the points in time at which the article 509 enters the irradiation area of the radiation tube 88 and at which the article 509 moves out of the irradiation area.

EXAMPLE 1

An example of the radiation tube is described with reference to FIGS. 4A and 4B, FIG. 5, and FIGS. 6A and 6B. In the radiation tube 88, the cathode 84 is joined to one end portion of the insulating tube 83 made of alumina, and the anode 85 is joined to the other end portion. In this manner, the enclosure is formed. The materials of the flange portions of the cathode and the anode are KOVAR. The anode 85 includes the target unit 12, the front shield 21, and the rear shield 64. The target unit 12 is formed by depositing tungsten having a size of $\phi$3 mm×t5 μm onto a surface of a diamond substrate adjacent to the cathode. The diamond substrate has a size of $\phi$5 mm×t2 mm. The front shield 21 is made of copper and is substantially cylindrical in shape. The front shield 21 has a size of $\phi$20 mm×t10 mm. A longitudinal width L1 of the slit-shaped opening 25 on the radiation side is 10 mm, and a longitudinal width L3 on the target unit side is 2.5 mm. The transverse width L2 is 2.5 mm. Thus, the opening 25 is tapered. The diameter D1 of the target is 3 mm, and the diameter d1 of the focal point is 2 mm. Thus, the condition $d1 < L2 \leq D1$ is satisfied. The rear shield 64 is made of copper and is substantially cylindrical in shape. The size of the rear shield 64 is $\phi$20 mm×t10 mm. The rear shield 64 has the cylindrical opening 66 of $\phi$2 mm. A depression having a size that is substantially the same as the size of the target unit 12 is formed in the rear shield 64. The target unit 12 is fitted into the depression and is brazed with silver alloy solder. In addition, the surface of the front shield 21 having the smaller opening 25 is brazed to a connection surface of the rear shield 64 with silver alloy solder.

The high voltage generation unit 82 includes a Cockcroft circuit. The high voltage generation unit 82 applies a voltage of about 40 kV to about 120 kV in accordance with the usage of the radiation. The electron source 86 is the impregnated cathode. The generated radiation is converted into a fan beam having a desired shape by the front shield 21 and is emitted to the outside. In addition, the radiation produced on the cathode side is effectively blocked by the rear shield 64.

EXAMPLE 2

Figure 8:
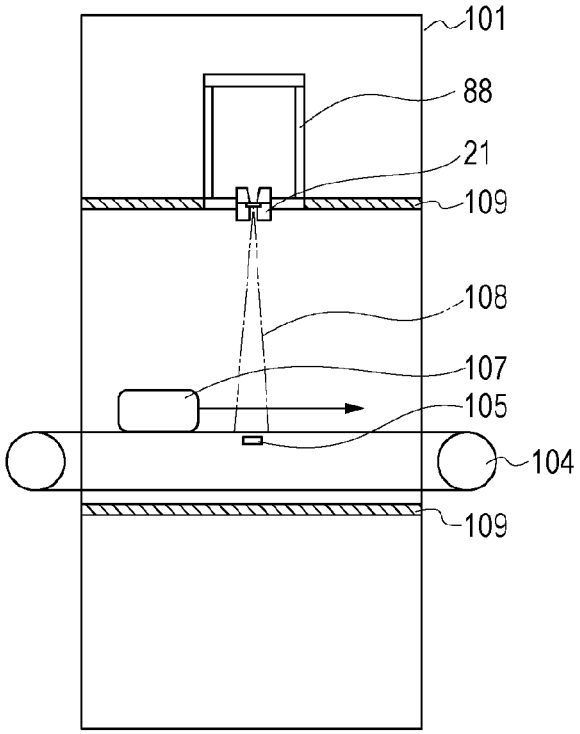
FIG. 8 is a schematic illustration of a radiation inspection apparatus according to EXAMPLE 2.
Figure 8:
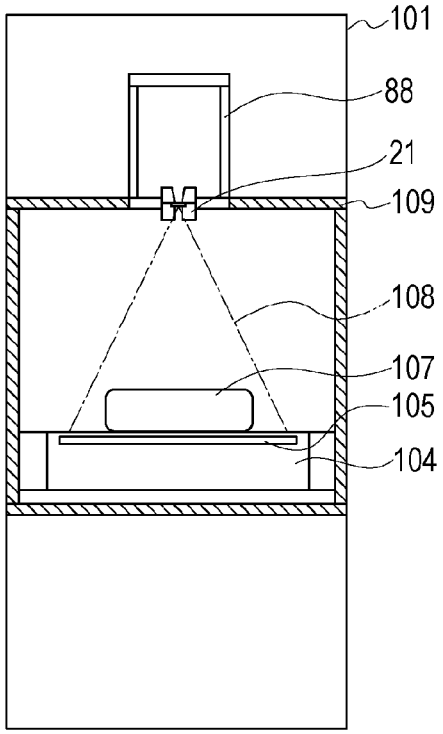

An example of the radiation inspection apparatus of the present invention is described below. FIG. 8 is a schematic cross-sectional front view and a schematic cross-sectional side view of the configuration of the radiation inspection apparatus of the present example. A radiation inspection apparatus 101 conducts inspection of a foreign substance using radiation emitted from the radiation tube 88 while an article 107 is being conveyed by a conveyance unit 104. The conveyance unit 104 is formed as a belt conveyer. By using drive motors disposed at both ends of the belt conveyer, the conveyance unit 104 conveys the article 107 to the right or left. The opening 25 of the front shield 21 is formed so that the longitudinal direction thereof is a direction that crosses the conveyance direction of the conveyance unit 104 and, more preferably, the longitudinal direction thereof is a direction that is perpendicular to the conveyance direction of the conveyance unit 104. As a result, the radiation emitted from the radiation tube 88 has a shape of a fan beam having a fan angle that provides an irradiation area larger than the size of the article 107 in a direction perpendicular to the conveyance direction and a radiation angle that provides the irradiation area sufficiently smaller than the size of the article in the conveyance direction. The radiation that has passed through the article 107 is detected by a line sensor 105 serving as the detector.

Figure 10:
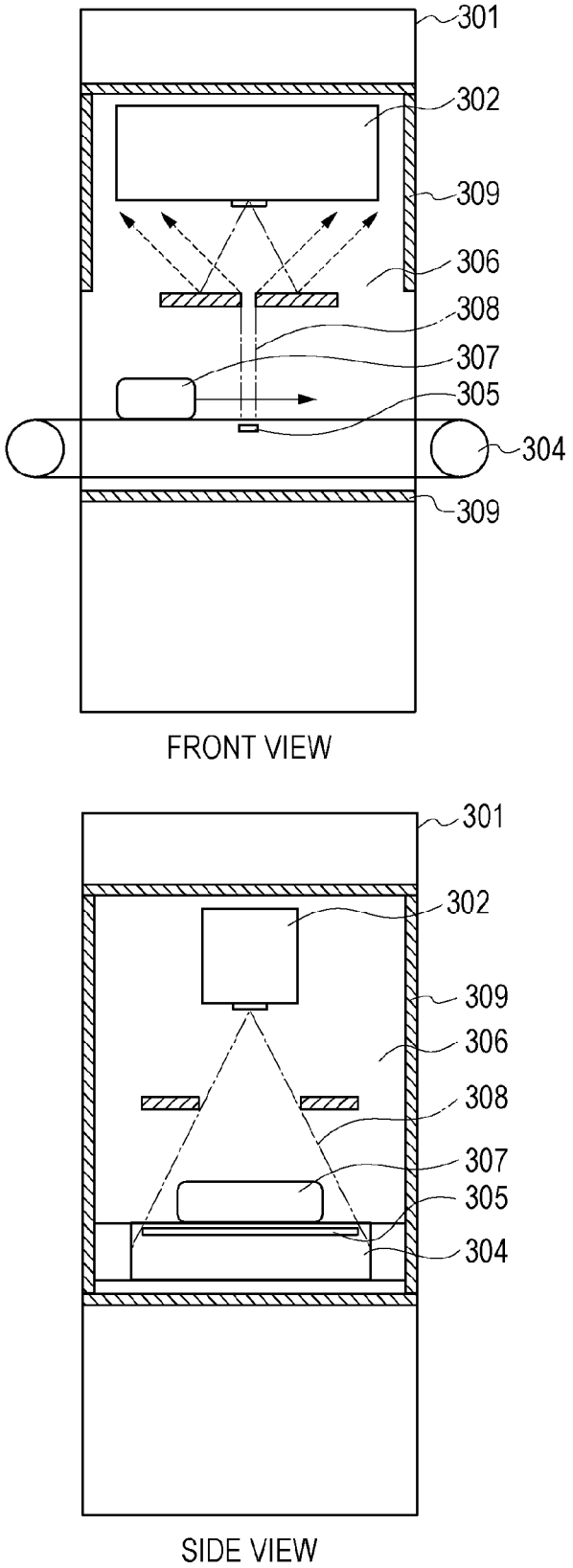
FIG. 10 is a schematic illustration of an existing radiation inspection apparatus.

The radiation inspection apparatus 101 of this example blocks unnecessary radiation using the front shield 21. Accordingly, the radiation inspection apparatus 101 does not have scattered radiation that occur from the slit forming member 306 in the existing radiation inspection apparatus illustrated in FIG. 10. As a result, even when a radiation shielding wall 109 is simplified, scattered radiation can be sufficiently blocked.

EXAMPLE 3

Figure 9:
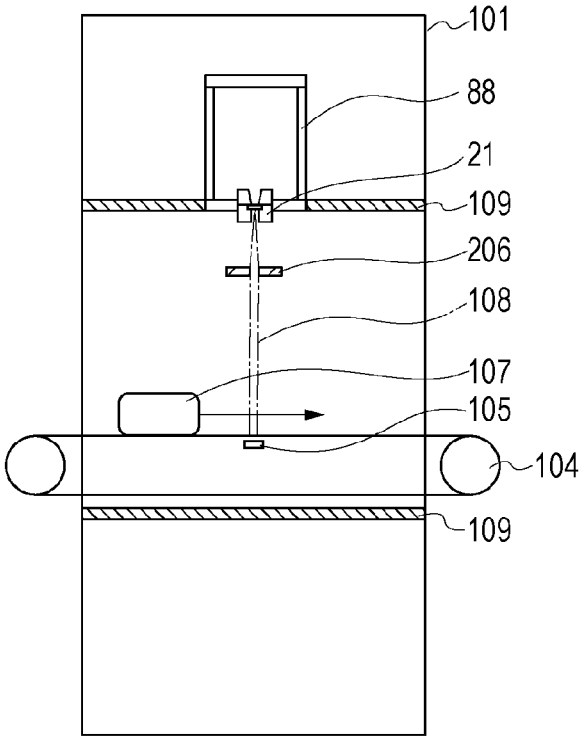
FIG. 9 is a schematic illustration of a radiation inspection apparatus according to EXAMPLE 3.
Figure 9:
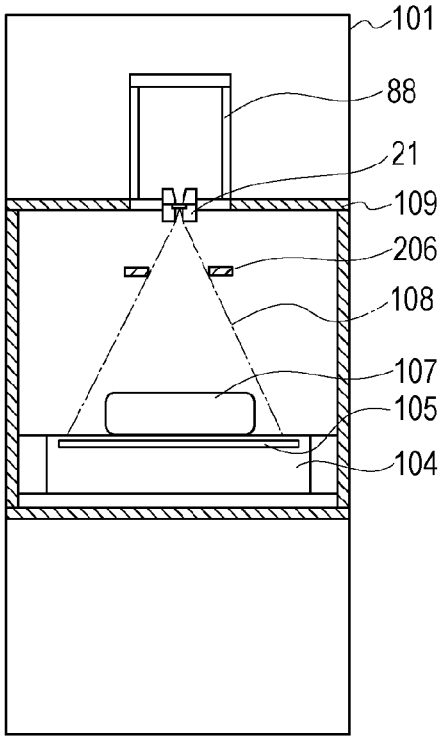

Another example of the radiation inspection apparatus of the present invention is described below. FIG. 9 is a schematic cross-sectional front view and a schematic cross-sectional side view of the configuration of the radiation inspection apparatus of the present example. The configuration is similar to that of EXAMPLE 2 except that a slit portion 206 is provided between the front shield 21 and the article 107. The slit portion 206 is made of tungsten. A slit-shaped opening (a slit) is formed so as to extend in a direction perpendicular to the conveyance direction of the conveyance unit 104. The longitudinal direction of the slit is the same as the longitudinal direction of the opening 25 of the front shield 21.

The radiation in the form of a fan beam emitted from the radiation tube 88 passes through the slit portion 206. Thus, the irradiation area is maintained in the direction perpendicular to the conveyance direction. In contrast, a fan beam having a smaller irradiation area is formed in the conveyance direction.

According to the present example, the resolution in the conveyance direction is increased and, thus, inspection can be conducted more accurately. In addition, the amount of radiation scattered by the slit portion 206 can be made significantly smaller than that in an existing radiation inspection apparatus. As a result, the radiation shielding wall 109 can be simplified and, thus, the size of the apparatus is reduced.

According to the present invention, by using the radiation tube including the front shield having a slit-shaped opening formed therein, radiation can be emitted in the form of a fan beam suitable for an inspection apparatus. In addition, since unnecessary radiation in a region around the target unit can be effectively blocked, scattering of the radiation between the target unit and a slit portion can be prevented. As a result, scattering of the radiation into a space other than an inspection space can be prevented and, thus, a safe and compact radiation inspection apparatus can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-254542 filed Dec. 9, 2013, which is hereby incorporated by reference herein in its entirety.

What is claimed is:

1. A radiation tube comprising:

an enclosure having an opening portion;

a cathode having an electron source configured to emit electrons disposed inside the enclosure;

an anode having a target unit configured to generate radiation in response to irradiation by being bombarded with electrons emitted from the electron source and a front shield configured to collimate the radiation and form a fan beam radiation, the front shield being disposed on the opening portion and having a proximal end closer to the target unit and a distal end farther from which the target unit than the proximal end; and an insulating tube having a pair of tube ends being connected to the cathode and the anode, respectively and configured to form a vacuum envelope with the cathode and the anode, wherein the front shield has a slit-shaped opening having a wide opening width and a narrow opening width, and wherein the wide opening width at the proximal end is larger than a diameter of the target unit and the narrow opening width at the proximal end is smaller than the diameter of the target unit.

2. The radiation tube according to claim 1, wherein the target unit includes a base member and a target layer film formed on a surface of the base member faced to the electron source, wherein the narrow opening width of the slit-shaped opening at the proximal end is greater than a diameter of a focal point of the radiation formed on the target layer film.

3. The radiation tube according to claim 1, wherein at least part of the front shield protrudes from the anode enclosure to the outside.

4. The radiation tube according to claim 1, wherein the slit-shaped opening is tapered so that the narrow opening width of the slit-shaped opening increases from the proximal side to the distal side.

5. The radiation tube according to claim 1, further comprising:

a rear shield disposed on the opposite side of the target unit from with respect to the front shield, wherein the rear shield has an electron passage hole that allows the electrons emerging from the electron source to pass through.

6. The radiation tube according to claim 5, wherein the electron passage hole is a cylindrical opening.

7. A radiation inspection apparatus comprising:

the radiation tube according to claim 1;

a conveyance unit configured to convey an inspection object article in a direction crossing a longitudinal direction of the slit-shaped opening; and a detection unit configured to detect radiation generated that is emitted from the radiation tube and transmitted through the inspection object that penetrates the article.

8. The radiation inspection apparatus according to claim 7, further comprising:

a slit member having a slit portion disposed between the front shield and the conveyance unit article, wherein a longitudinal direction of a slit of formed in the slit portion is oriented in parallel to the same as the longitudinal direction of the slit-shaped opening.

9. The radiation tube according to claim 1, wherein the slit-shaped opening shows an aspect ratio no less than 2 and no greater than 50.

10. A radiation tube according to claim 9, wherein the aspect ratio of the slit-shaped opening is no less than 4 and no greater than 20.

11. The radiation tube according to claim 2, wherein the wide opening width and the narrow opening width of the slit-shaped opening at the proximal end is larger than the diameter of the target layer.

12. The radiation tube according to claim 1, wherein the slit-shaped opening defines a fan angle and a radiation angle narrower than the fan angle of the fan beam.

13. The radiation tube according to claim 1, wherein the proximal end of the front shield is connected to the target unit.

* * * * *